US005493172A

United States Patent [19]

Kouno et al.

[11] Patent Number: 5,493,172

[45] Date of Patent: Feb. 20, 1996

[54] FLAT CATHODE RAY TUBE

[75] Inventors: Yoji Kouno, Kanagawa; Masahiro Kikuchi, Tokyo, both of Japan

[73] Assignee: Sony Corporation, Tokyo, Japan

[21] Appl. No.: 206,654

[22] Filed: Mar. 7, 1994

[30] Foreign Application Priority Data

Mar. 10, 1993 [JP] Japan ..... 5-049451

[51] Int. Cl.[6] ..... H01J 29/86

[52] U.S. Cl. ..... 313/477 R; 313/422; 220/2.1 A

[58] Field of Search ..... 313/422, 477 R; 220/2.1 R, 2.1 A, 2.3 A

[56] References Cited

U.S. PATENT DOCUMENTS

| | | | |
|---|---|---|---|
| 4,588,430 | 5/1986 | Sumiyoshi et al. | 313/477 R |
| 4,723,090 | 2/1988 | Maeda et al. | 313/477 R |
| 4,754,190 | 6/1988 | Hinotami et al. | 313/477 R |

*Primary Examiner*—Donald J. Yusko
*Assistant Examiner*—Nimesh D. Patel
*Attorney, Agent, or Firm*—Hill, Steadman & Simpson

[57] ABSTRACT

In a flat cathode ray tube, a flat glass tube is of three-element structure includes a screen panel integrally provided with skirt portions which are erected from the screen panel along the front end and the opposite side portions thereof continuously, a front panel or a back panel of a sheet-like configuration, and a funnel portion having a neck portion. The screen panel, front panel and funnel portion are combined through frit glasses, and a phosphor screen is formed on the inner surface of the screen panel. An electron gun is disposed within the neck portion, so that an electron beam generated from the electron gun collides with molecules within the flat glass tube to generate negative ions. The negative ions are accelerated and irradiated at the center portion on the skirt portion provided at the front end of the screen panel, whereby the phosphor screen is prevented from being burned by the ions and degradation of the frit glass due to impact of the negative ions is prevented.

2 Claims, 3 Drawing Sheets

FLAT CATHODE RAY TUBE

BACKGROUND OF THE INVENTION

1. Field of the Invention

The present invention relates to a flat cathode ray tube.

2. Description of the Prior Art

As shown in FIGS. 1 and 2, a flat cathode ray tube 6 of a reflection type (or a transmission type) is known in which a flat glass tube 5 is comprised of a three-element structure including a screen panel 1, a front panel (or a back panel) 2, and a funnel portion 4 having a neck portion 3. The flat glass tube 5 is made such that the screen panel 1 and the front panel (or the back panel) 2 are opposed and combined along one end thereof through a frit glass 10 so as to form a flat space 7 therebetween, the funnel portion 4 is combined along its one end to the other end of these panels through the frit glass 10, and the neck portion 3 is welded to the funnel portion 4 at its one open end with a smaller diameter. An electron gun 8 is disposed within the neck portion 3.

The screen panel 1 is configured to be integrally provided with skirt portions 1*a* and 1*b* which are erected therefrom along the front end and the opposite side portions thereof continuously. Like the screen panel 1, the front panel (or the back panel) 2 is also configured with skirt portions 2*a* and 2*b* which are erected therefrom along the front end and the side portions thereof continuously. The panels 1 and 2 are combined through the frit glass 10 such that the skirt portions 1*a* and 1*b* oppose the skirt portions 2*a* and 2*b*, respectively.

In a flat cathode ray tube of the reflection type, a phosphor screen 9 is formed on the inner surface of the screen panel 1 through a reflection film formed by vapor deposition of aluminum, for example. An electron beam emitted from the electron gun 8 scans the phosphor screen 9 in the horizontal and vertical directions, so that the phosphor screen 9 is exited by the beam to emit light and hence an optical image formed by the emitted light is viewed from the front panel 2 side opposite the screen panel 1.

In a flat cathode ray tube of the transmission type, the phosphor screen 9 is formed on the inner surface of the screen panel 1 through a transparent conductive film. An electron beam emitted from the electron gun 8 scans the phosphor screen 9 in the horizontal and vertical directions, so that the phosphor screen is exited by the beam to emit light and hence an optical image formed by the emitted light is viewed from the screen panel 1 side opposite to the back panel 2.

If the flat cathode ray tube 6 is manufactured in a manner such that the electron beam is introduced straightly and impinges on the phosphor screen 9 when the electron beam is not subjected to deflection, the phosphor screen 9 may be burnt by ions and so image quality may be greatly degraded. In order to prevent such burning by the ions, the funnel portion 4 is inclined by a predetermined angle and combined to the screen panel 1 and the front panel (or the back panel) 2 so that the electron beam does not impinge on the phosphor screen 9 when the electron beam is not subjected to deflection.

In the flat cathode ray tube 6, when, during operation of the cathode ray tube, the electron beam emitted from the electron gun 8 collides with residual molecules within the flat glass tube 5, ions are generated. Negative ions thus generated by such collisions are not deflected by deflection coils, and these negative ions are accelerated by voltage charged up on the inner surface of the flat glass tube by an anode voltage (about 7 KV) from the flat cathode ray tube 6 and hence are introduced along a locus 11 shown in FIG. 1 and then impinge on the connection of the front end of the flat glass tube 5, that is, around the frit glass 10.

Since the negative ions are not deflected as described above, the negative ions continue to impinge on the same portion, that is, around the frit glass 10 at the front end of the flat glass tube 5 during the operation of the flat cathode ray tube 6. Consequently, the frit glass 10 is heated due to the kinetic energy of the negative ions.

It is clear from the characteristic curve I representing a viscosity of the frit glass 10 shown in FIG. 3, that the frit glass 10 is softened and melted at temperatures lower than those of the glass for the screen panel 1 and the front panel (or the back panel) 2 as shown by a viscosity characteristic curve II thereof. Therefore, when the negative ions impinge on the frit glass 10 for a long period of time, the frit glass 10 is heated and softened, so that there is a risk that the frit glass 10 can not maintain its original function, that is, combining of the glass panels

OBJECTS AND SUMMARY OF THE INVENTION

It is an object of the present invention to provide a flat cathode ray tube in which the aforementioned shortcomings and disadvantages encountered with the prior art are eliminated.

More specifically, it is an object of the present invention to provide a flat cathode ray tube which decreases the probability that negative ions impinge on the frit glass, thereby improving the reliability of the tube.

According to the present invention, the phosphor screen is not burnt by the ions and further the negative ions generated from operation of the cathode ray tube are introduced to a portion of the tube away from the frit glass and thus impinge on a skirt portion provided at the front end of a screen panel.

In the present invention, a flat cathode ray tube is comprised of a flat glass tube of a three-element structure including a screen panel integrally provided with skirt portions which are erected from the screen panel along a front end and opposite side portions thereof continuously, a front panel or a back panel of sheet-like configuration, and a funnel portion having a neck portion; a phosphor screen formed on an inner surface of the screen panel; and an electron gun disposed within the neck portion, wherein the screen panel, front panel and funnel portion are combined through frit glasses, and an electron beam generated from the electron gun collides with molecules within the flat glass tube to generate negative ions, and the negative ions are accelerated and irradiated at the center portion on the skirt located at the front end of the screen panel.

According to the present invention, preferably, the screen panel constituting the flat glass tube is integrally provided with skirt portions which are erected therefrom along the front end and the opposite side portions thereof continuously, and the front panel or the back panel is configured in a sheet-like configuration. The screen panel and the front panel are combined through the frit glass, whereby the center portion of the negative ions (that is, a locus of the negative ions) generated by the electron beam during operation of the cathode ray tube impinge on the skirt portion at the front end of the screen panel which is away from the connection between the screen panel and the front panel (or the back panel), that is, the connection made with the frit glass. Accordingly, the likelihood that the negative ions impinge on the frit glass can be decreased to thereby maintain the original function of the frit glass.

Additionally, since, when the electron beam is not deflected, the center of the electron beam is irradiated on the skirt portion at the front end of the screen panel which is separate from the phosphor screen, the phosphor screen is thus prevented from being burnt by the ions.

The preceding and other objects, features, and advantages of the present invention will become apparent from the following detailed description of an illustrative embodiment thereof when read in conjunction with the accompanying drawings.

DESCRIPTION OF THE PREFERRED EMBODIMENT

An embodiment of the flat cathode ray tube according to the present invention will now be described with reference to FIGS. 4 through 6.

Figure 1:
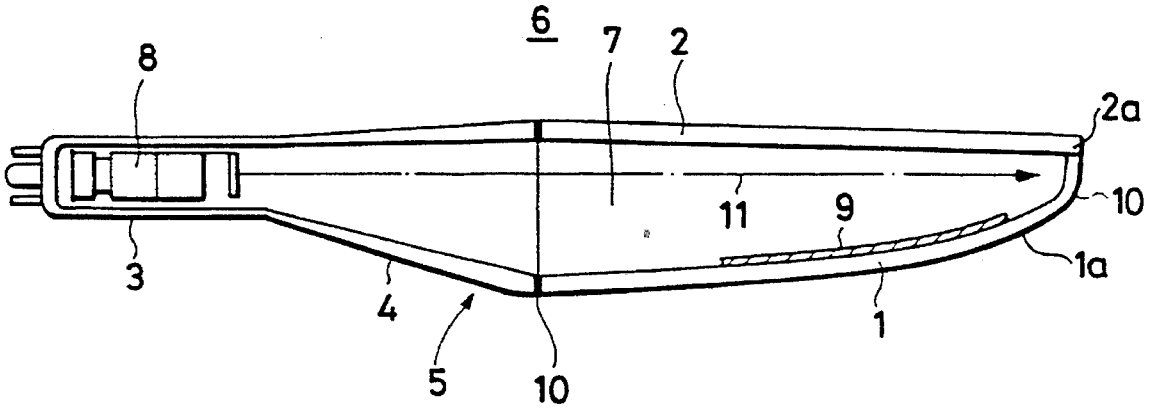
FIG. 1 (RELATED ART)
FIG. 1 is a sectional view illustrating a flat cathode ray tube of the related art
Figure 2:
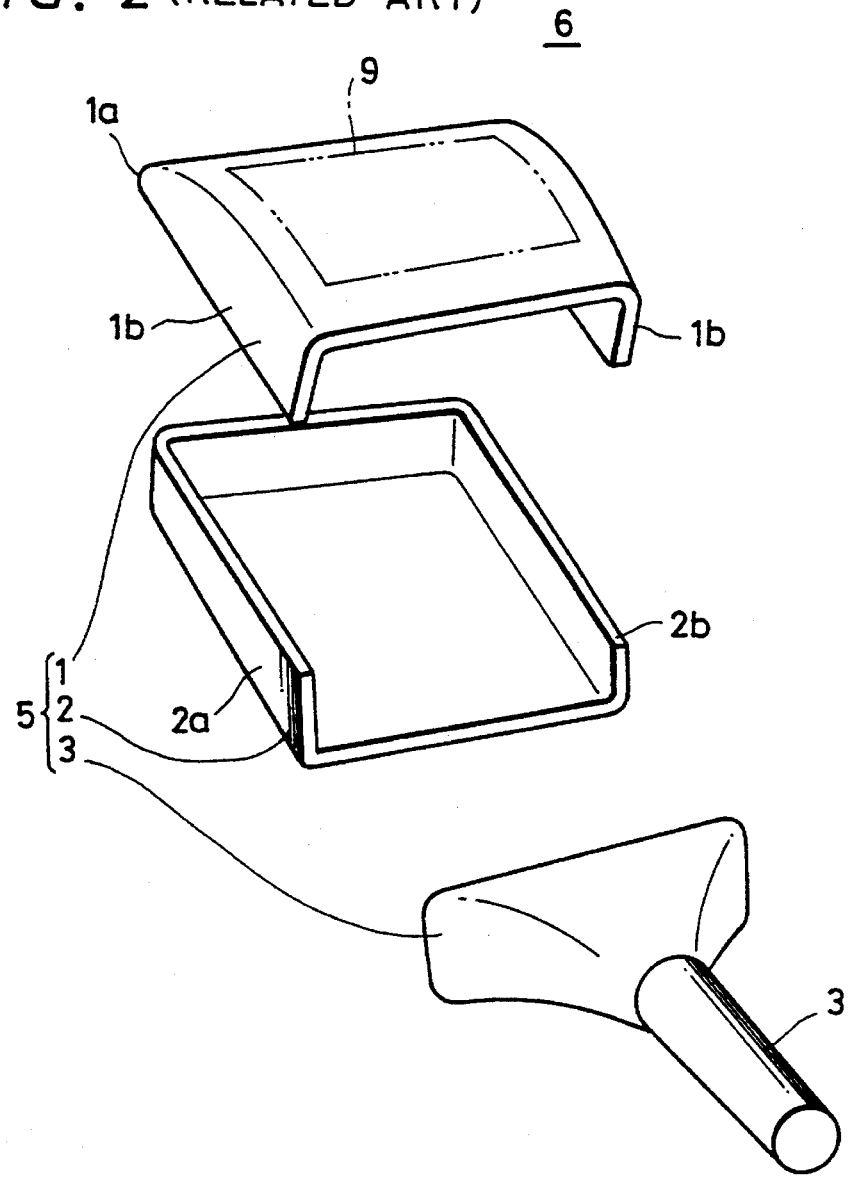
FIG. 2 (RELATED ART)
FIG. 2 is a schematic exploded perspective view illustrating the flat glass tube shown in FIG. 1.
Figure 3:
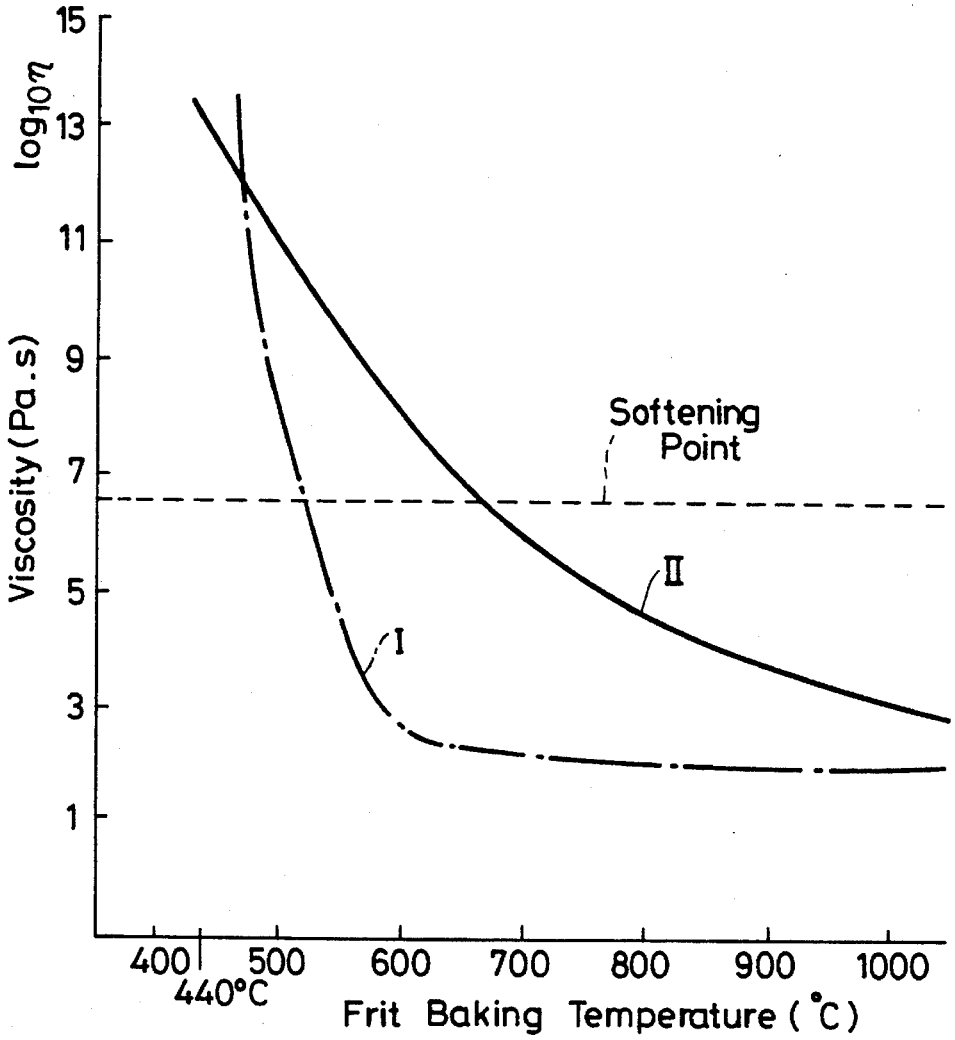
FIG. 3 (RELATED ART)
FIG. 3 is a graph representing characteristic curves for viscosities of frit glass and glass for the tube.
Figure 4:
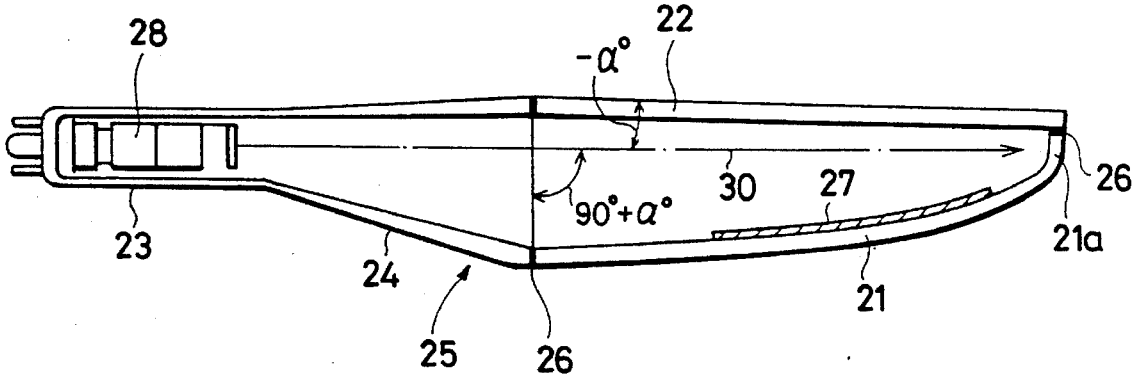
FIG. 4 is a sectional view illustrating an embodiment of a flat cathode ray tube according to the present invention.
Figure 5:
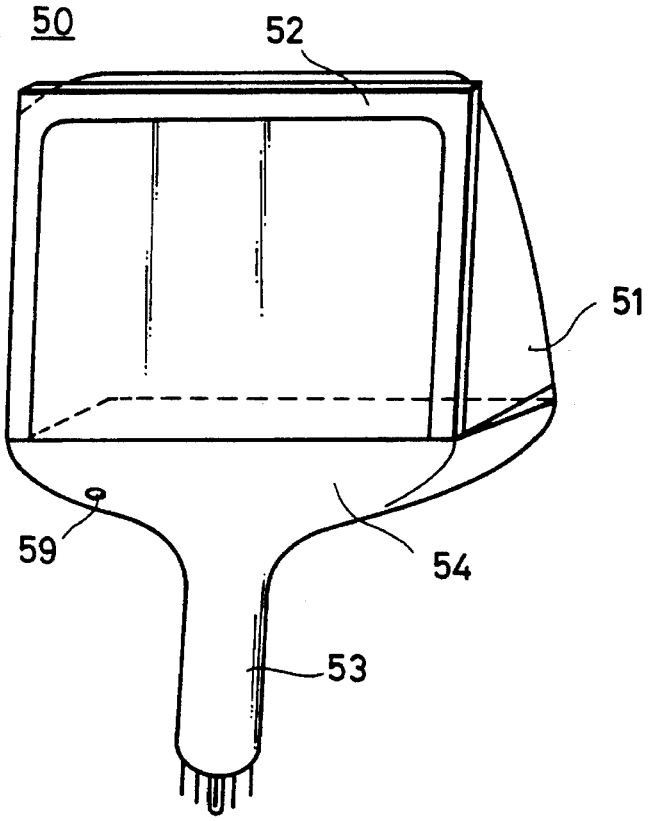
FIG. 5 is a perspective view illustrating the flat cathode ray tube shown in FIG. 4.
Figure 6:
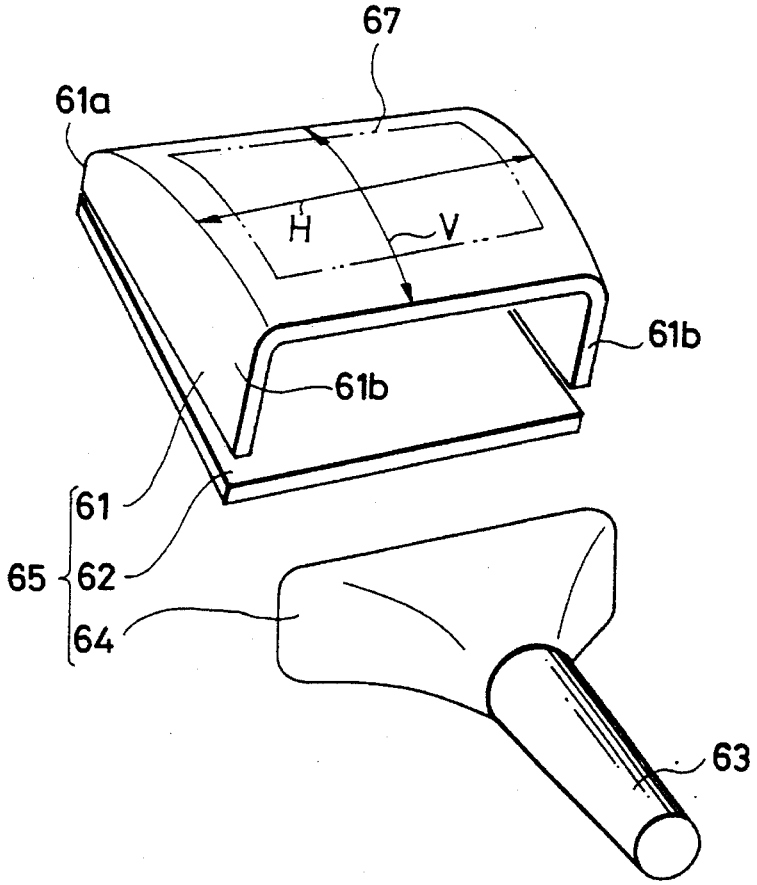
FIG. 6 is an exploded perspective view illustrating the flat glass tube of the present invention shown in FIG. 4.

According to the embodiment shown in FIGS. 4, 5 and 6, a flat glass tube 25 (65) is comprised of a three-element structure made of glass including a screen panel 21 (51, 61), a front panel (or a back panel) 22 (52, 62), and a funnel portion 24 (54, 64) having a neck 23 (53, 63) integrally combined therein through welding or the like, and these three elements are combined through frit glasses 26 (see FIG. 4) to thereby complete the flat glass plate.

As shown in FIG. 6 the screen panel 61 is formed in a curved fashion which is flat in the horizontal direction H and curved with a predetermined curvature in the vertical direction V which is orthogonal to the horizontal direction H. The screen panel 61 is integrally provided with skirt portions 61*a*, 61*b* which extend upward therefrom along the front end and the opposite sides thereof continuously.

The screen panel 21 (51, 61) is formed in the following manner. A mold (not shown) having a symmetrical configuration about the center line thereof is formed by press molding or the like and the mold is cut at the center line thereof into two parts, each of which constitutes the screen panel 21 (51, 61).

The front panel (or the back panel) 22 (52, 62) is formed by a sheet glass of a square flat or sheet-like configuration, each pair of whose opposite sides are disposed in parallel.

As shown in FIGS. 4 through 6, a phosphor screen 27 (67) is formed on a predetermined area of the inner surface of the screen panel 21 (51, 61) such that the screen does not extend to the skirt portions 21*a* (61*a*), 21*b* (61*b*). An electron gun 28 is disposed within the neck portion 23 (53, 63). The phosphor screen 27 (67) receives an anode voltage HV from an anode button 29 (59) (see FIG. 5).

In this respect, the flat glass tube 25 (65) is arranged such that the outer surface of the front panel (or the back panel) 22 (52, 62) is inclined by an angle of $-\alpha$ degrees with respect to an axis of an electron beam which is the same as a locus 30 of negative ions shown in FIG. 4 so that the electron beam does not impinge on the phosphor screen 27 (67) when the electron beam is not deflected. Accordingly, a sealing plane of the frit glass 26 between the funnel portion 24 (54, 64) and the screen panel 21 (51, 61), the front panel (or the back panel) 22 (52, 62) is inclined by an angle of $(90+\alpha)$ degrees with respect to the axis of the electron beam. Consequently, when the electron beam is not deflected, the electron beam is irradiated on a position away from the phosphor screen 27 (67), that is, the skirt portion 21*a* (61*a*) at the front end of the screen panel 21 (51, 61).

During operation of the cathode ray tube, negative ions are generated when the electron beam emitted from the electron gun collides with residual molecules which are then accelerated to thereby be introduced along the locus 30. That is, the negative ions do not impinge on the connection between the front panel (or the back panel) 22 (52, 62) and the screen panel 21 (51, 61), that is, the frit glass area 26 but rather they impinge on the skirt portion 21*a* (61*a*) at the front end of the screen panel 21 (51, 61) which is away from the frit glass 26.

When the flat cathode ray tube is of the reflection type, the phosphor screen 27 (67) is formed on the inner surface of the screen panel 21 (51, 61) through a reflection film formed by vapor deposition of aluminum, for example, so that an optical image can be viewed from the front panel 22 (52, 62) side.

When the flat cathode ray tube is of the transmission type, the phosphor screen 27 (67) is formed on the inner surface of the screen panel 21 (51, 61) through a transparent conductive film, for example, an indium tin oxide (ITO) film. A conductive film, for example, a carbon film, is applied on substantially the entire surface of which the anode voltage is applied, by deposition on the inner surface of the back panel 22 (52, 62) such that the conductive film opposes the phosphor screen 27 (67), so that an optical image can be viewed through the screen panel 21 (51, 61).

Accordingly, in the flat cathode ray tube 31 (50), when the electron beam is not deflected, the electron beam is introduced and irradiated on the skirt portion 21*a* (61*a*) at the front end of the screen panel 21 (51, 61) which is away from the phosphor screen 27 (67), so that the electron beam does not impinge on the phosphor screen 27 (67) thereby preventing the phosphor screen from being burnt by the ions.

Additionally, the screen panel 21 (51, 61) is integrally provided with the skirt portions 21*a* (61*a*), 21*b* (61*b*) which extend upward therefrom along the front end and the opposite sides thereof continuously, and the front panel (or the back panel) 22 (52, 62) is formed in a square sheet-like configuration such that each pair of the opposite sides thereof are disposed in parallel and then combined to the screen panel through a fritting procedure. Accordingly, the negative ions, which are generated when the electron beam emitted from the electron gun collides with residual molecules which are then accelerated by the voltage charged up on the inner surface of the glass tube by the anode voltage to thereby be introduced along the locus 30, do not impinge on the connection between the front panel (or the back panel) 22 (52, 62) and the screen panel 21 (51, 61), that is, the frit glass 26 but rather they impinge on the skirt portion

21*a* (61*a*) at the front end of the screen panel 21 (51, 61) which is away from the frit glass.

Consequently, the probability that the negative ions impinge on the frit glass 26 can be decreased remarkably, so that the original quality of the frit glass seal is maintained and the reliability of the flat cathode ray tube 31 (51) can be improved.

According to the flat cathode ray tube 31 (50) of the preferred embodiment, the front panel (or the back panel) 22 (52, 62) is formed in a square sheet-like configuration such that each pair of the opposite sides thereof are disposed in parallel and so the connection through the frit glass between the front panel (or the back panel) 22 (52, 62) and the screen panel 21 (51, 61) is shifted to the front panel side (or the back panel side) when compared with the conventional flat cathode ray tube. Therefore, when the electron gun 28 is inclined so that the locus of the negative ions, that is, the center of the electron beam without deflection is away from the frit glass 26, the degree of freedom as to the designing of the inclination is improved and manufacturing and assembling of the flat cathode ray tube is facilitated.

As set out above, in the flat cathode ray tube according to the present invention, the phosphor screen is prevented from being burnt by the ions and the negative ions generated upon operation of the cathode ray tube are prevented from impinging on the frit glass, so that the original function of the frit glass is maintained and the reliability of the flat cathode ray tube can thus be improved.

Having described the preferred embodiment of the invention with reference to the accompanying drawings, it is to be understood that the invention is not limited to the precise embodiment and that various changes and modifications thereof cold be effected by one skilled in the art without departing from the spirit or scope of the novel concepts of the invention as defined in the appended claims.

What is claimed is:

1. A flat cathode ray tube comprising:

a flat glass tube including a screen panel with skirt portions which extend upward from said screen panel along a front end and opposite side portions thereof continuously, and a sheet-like panel;

a phosphor screen formed on an inner surface of said screen panel; and an electron gun opposite the front end of the screen panel, wherein said screen panel and sheet-like panel are combined with frit glasses to form a seal, and a non-deflected electron beam generated from said electron gun collides with the front end portion of the screen panel away from the seal and the phosphorous screen and wherein a stream of negative ions impact a portion of the screen panel away from the seal and phosphorous screen.

2. A flat cathode ray tube according to claim 1, wherein said screen panel is integrally provided with skirt portions which extend upward from said screen panel along said front end and said opposite side portions thereof continuously.

* * * * *